United States Patent [19]

Baudro

[11] Patent Number: 4,638,166

[45] Date of Patent: Jan. 20, 1987

[54] RADIATION SHIELD

[75] Inventor: Thomas O. Baudro, Gales Ferry, Conn.

[73] Assignee: Proto-Power Corporation, Groton, Conn.

[21] Appl. No.: 707,070

[22] Filed: Mar. 1, 1985

[51] Int. Cl.[4] ..... G21F 3/00

[52] U.S. Cl. ..... 250/515.1; 250/517.1; 250/519.1; 160/32; 160/129; 160/130; 160/168 R; 160/169

[58] Field of Search ..... 250/515.1, 517.1, 519.1; 160/8, 23 R, 32, 129, 130, 168 R, 169

[56] References Cited

U.S. PATENT DOCUMENTS

| | | |
|---|---|---|
| 63,853 | 4/1867 | Carlson . |
| 66,829 | 7/1867 | Goewey . |
| 158,455 | 1/1875 | Babson . |
| 763,853 | 6/1904 | Carlson . |
| 1,607,140 | 11/1926 | Wappler . |
| 1,628,511 | 5/1927 | Petersen . |
| 1,907,523 | 5/1933 | Egressi . |
| 1,923,424 | 8/1933 | Dailey . |
| 2,718,598 | 9/1955 | Graf . |
| 2,942,115 | 6/1960 | O'Connell . |

FOREIGN PATENT DOCUMENTS

| | | | |
|---|---|---|---|
| 1073800 | 2/1984 | U.S.S.R. | 250/515.1 |

*Primary Examiner*—Craig E. Church
*Assistant Examiner*—Jack I. Berman
*Attorney, Agent, or Firm*—Pasquale A. Razzano

[57] ABSTRACT

A portable and collapsible radiation shielding device is provided for the protection of personnel and equipment from ionizing radiation. The shield has a plurality of horizontally elongated slats of radiation shielding material, such as lead wool, hung from a plurality of horizontally spaced apart chains at spaced intervals along the length of the chains. The slats are connected to the chains near their top edges so that when they are in their raised state the slats are suspended from the chains and arranged in an overlapping manner, like shingles, and when collapsed arrange themselves neatly side by side in a stack. The device also has a container adapted to receive the shield in its collapsed state, and a hoist and mast for raising and lowering the shield into and out of the container. The container further has wheels for facilitating moving the device to the desired location, and an outrigger for providing stability to the shield when raised. The mast is dissassemblable so that it can be stored within the container along with the shield when not in use. The container may also have an opening at an end to facilitate removal of the radiation shield from the container when it is supported by means other than the mast.

23 Claims, 9 Drawing Figures

FIG. 5
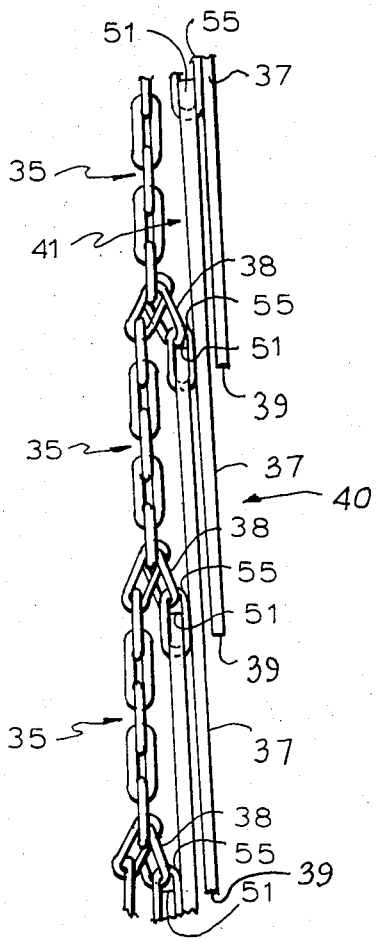
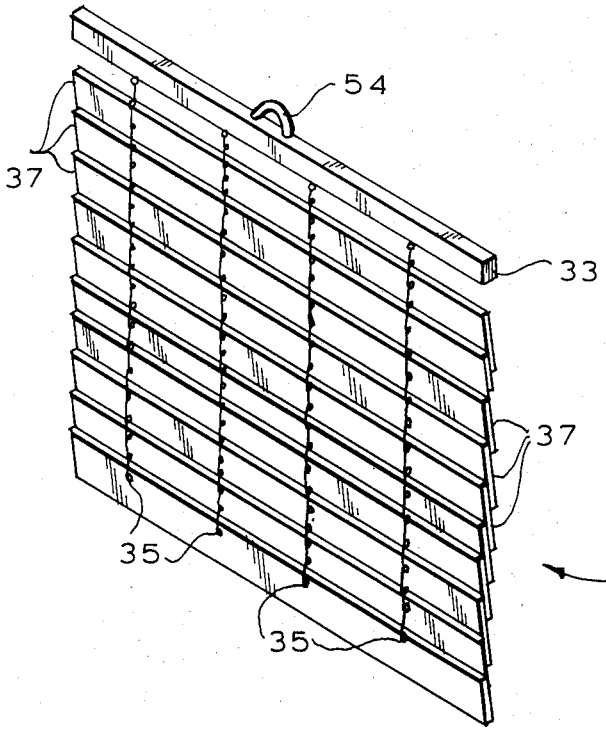
FIG. 4

RADIATION SHIELD

BACKGROUND OF THE INVENTION

The present invention relates to biological shielding from ionizing radiation for the protection of personnel and radiation sensitive equipment. More particularly, it relates to radiation shielding which is collapsible and can be relocated from place to place.

The hazard to personnel from ionizing radiation of the type commonly encountered in areas where radioactive material is used or handled is well known. In order to protect personnel from this hazard, it is necessary either to provide shielding of dense, radiation absorbing materials such as lead or concrete in sufficient thickness to provide adequate protection, or to keep personnel at a safe distance from the radioactive source. Both methods are commonly employed in practice, so that areas where personnel are frequently found are heavily shielded and areas where personnel are very seldom found may be only lightly shielded.

When it is necessary for personnel to enter an area which is only lightly shielded, or when a source of ionizing radiation is brought into an area which is normally free of such radiation, temporary radiation shielding is frequently erected. This shielding usually consists of individual pieces of radiation shielding material such as lead blocks, lead sheets, lead-wool blankets, steel plates, water tanks or concrete blocks. This temporary shielding is bulky, cumbersome and unwieldly to erect and move. The individual pieces of shielding material are transported through congested areas and supported from whatever structure is available. The bulk and mass of these individual shielding pieces also present difficulties in storage and decontamination.

Existing radiation shielding is difficult and time consuming to erect, and personnel handling such shielding materials are exposed to radiation from the radioactive sources requiring the shielding during the time needed to erect and dismantle the shields in piecemeal fashion. Consequently, existing shielding is often arranged in a haphazard manner, resulting in spotty and uneven protection in a given area exposing personnel to higher than necessary levels of radiation. Furthermore, the piece by piece erection of existing shielding is labor intensive. In addition, the great weight of the shielding material, and the haphazard erection of current radiation shields can itself pose an additional hazard to personnel because if not carefully and safely erected, a shield constructed of prior art radiation shielding tends to be unstable and can be easily toppled.

OBJECTS OF THE INVENTION

It is an object of this invention to provide a portable, compact, collapsible and easily erectable biological radiation shield to protect personnel who are in the vicinity of radioactive material from radiation exposure.

A further object of this invention is to provide a radiation shielding system which is self-storing, self-supporting, and self-erectable.

A still further object of this invention is to provide a radiation shielding system which is stable when erected.

Another object of this invention is to provide a radiation shielding system which is easy to transport, store, and decontaminate.

Yet another object of this invention is to provide a radiation shielding system providing a known, and predictable level of radiation attenuation protection.

SUMMARY OF THE INVENTION

In accordance with an aspect of the present invention a radiation shielding system is provided which includes a collapsible radiation shield that can be raised and collapsed for storage, a support structure for the shield and a mast or upright support member attached to the support structure for supporting the collapsible radiation shield in its raised position. Means are also provided for raising the radiation shield from its collapsed state to its raised state.

In a preferred embodiment, the radiation shield comprises a plurality of horizontally elongated slats of radiation shielding material. These slats are attached to a plurality of horizontally spaced apart chains at intervals along the length of the chains. The slats are connected to the chains near their top edges so that when they are in their raised state the slats are suspended from the chains and arranged in an overlapping manner. Instead of chains, cables can be used. Preferably, the width of the slats is such that when raised they sufficiently overlap each other so that the mean effective thickness for radiation attenuation is approximately double the thickness of each individual slat. This will provide a consistent and predictable radiation attentuation. The slats may be solid pieces of material such as lead, or steel, or lead laminated between another metal such as steel or aluminum or slat-shaped lead wool blankets.

When the shield is in its collapsed condition, the slats are arranged in a stack with the front of each of the slats juxtaposed against the back of the adjacent slat in front of it, and the chains are collapsed near the top edge of the slats. The slats remain in a substantially horizontal position throughout the movement from the raised position to the lowered position.

In another embodiment, the support structure includes a container or box adapted to receive the radiation shield when it is in the collapsed condition to facilitate storage, transportation, and handling of the radiation shield. In a further embodiment, the container has an opening at at least one end, to facilitate removal of the radiation shield from the frame and container when it is supported by means other than the mast.

The support structure for the radiation shielding system may include an outrigger member extending in a direction generally normal to the plane of the radiation shield when the shield is in its raised condition. The outrigger has an outward end at grade level for supporting and stabilizing the radiation shielding system. Preferably the mast and outrigger member are demountable from the support structure.

In this embodiment, the support structure includes a mast guide bracket adapted to receive the mast, and the outrigger member includes a connection member and a tubular mast support post adapted to receive the mast. The support structure also includes a connection member bracket adapted to receive the connection member. This connecting member bracket is positioned with respect to the other brackets so that when the outrigger member is mounted to the support structure, the mast will be fixed in place by both the mast guide bracket and the mast receiving bracket. In this way, if the outrigger member is not properly mounted, the mast cannot be supported from the mast guide bracket alone without instability obvious to the operator. This is a very desirable safety feature because radiation shielding material is dense and very heavy. Without proper mounting of the outrigger member, the radiation shielding system may be top heavy and unstable, causing a risk of injury to the operator. It is also preferred that the upright support member be capable of disassembly to a size such that it will fit within the container, to facilitate storage.

The means for lifting the radiation shield from its collapsed position to the raised condition may be any conventional hoisting apparatus, such as an electric or manually operated winch and cable, a screw jack or a hydraulic jack. A lifting bar may be included at the top of the collapsible radiation shield to provide additional structural rigidity when the radiation shield is in its raised condition. If slats are rigid, a lifting bar would not be required.

The arrangement of mast, lifting means, lifting bar, and horizontally collapsible radiation shield allows fast, easy, and safe erection of the radiation shield by the use of the lifting means after the radiation shield is brought to the desired location. In this way, exposure of personnel to radiation during erection of the radiation shield is reduced to a minimum. Furthermore, because the radiation shielding system has a low center of gravity in its collapsed condition, and is stable and tip resistant in its raised condition, personnel safety is further enhanced.

When a container is provided, lowering the shield into the container will cause the slats to neatly arrange themselves into a stack with the front of each of the slats juxtaposed against the back of the slat which is adjacent to and in front of it. The suspension means or chains will also collapse near the top edge of the slats. Because the slats are slightly tipped with their top edges slightly further back toward the suspension means, when lowered into the container the slats will have a tendency to remain generally in the same orientation, with the upper slat sliding down to arrange itself in front of the slat which was suspended immediately below it. Raising the shield is easily accomplished in the reverse manner.

The radiation shield is not attached to the container or frame, thus, the radiation shield alone may be supported from a separate structure independent of the enclosure or frame and mast, if desired.

The above and other objects, features and advantages of the present invention will be apparent from the following detailed description of illustrative embodiments thereof which is to be read in conjunction with the accompanying drawings, wherein:

BRIEF DESCRIPTION OF THE DRAWINGS

FIG. 4 is a perspective view illustrating the backside of the radiation shield of FIGS. 1, 2, and 3, alone, without the container or support member.

FIG. 5 is an enlarged partial side view illustrating a detail of the attachment of the slats to the suspended chains, and showing the continuity of double thickness;

DETAILED DESCRIPTION

Figure 1:
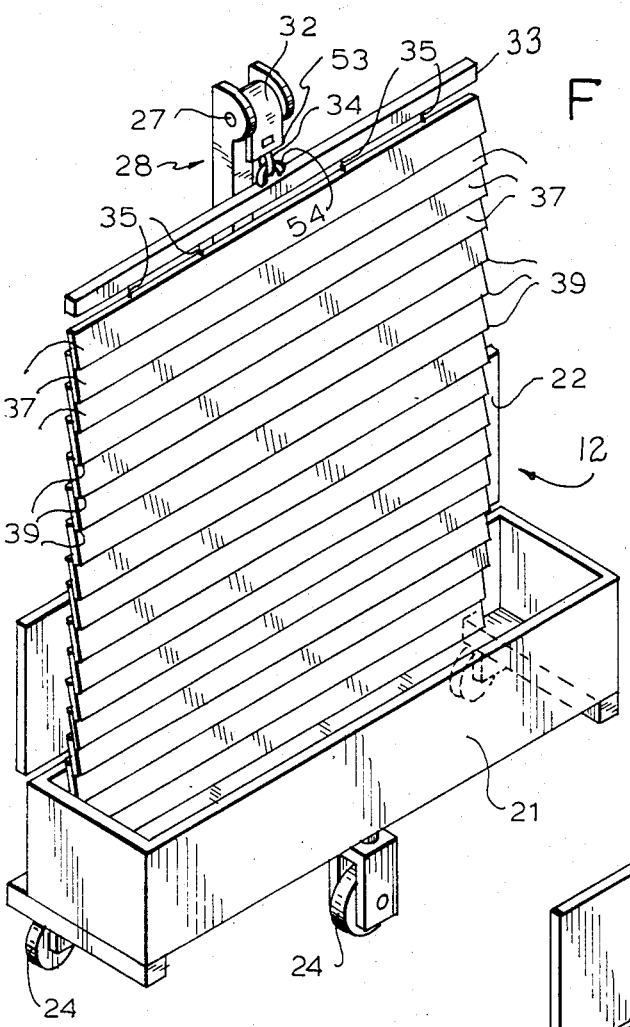
FIG. 1 is a perspective front view of a collapsible radiation shielding system using a horizontal slat type shield according to one embodiment of the present invention, with the shield in its raised position.
Figure 2:
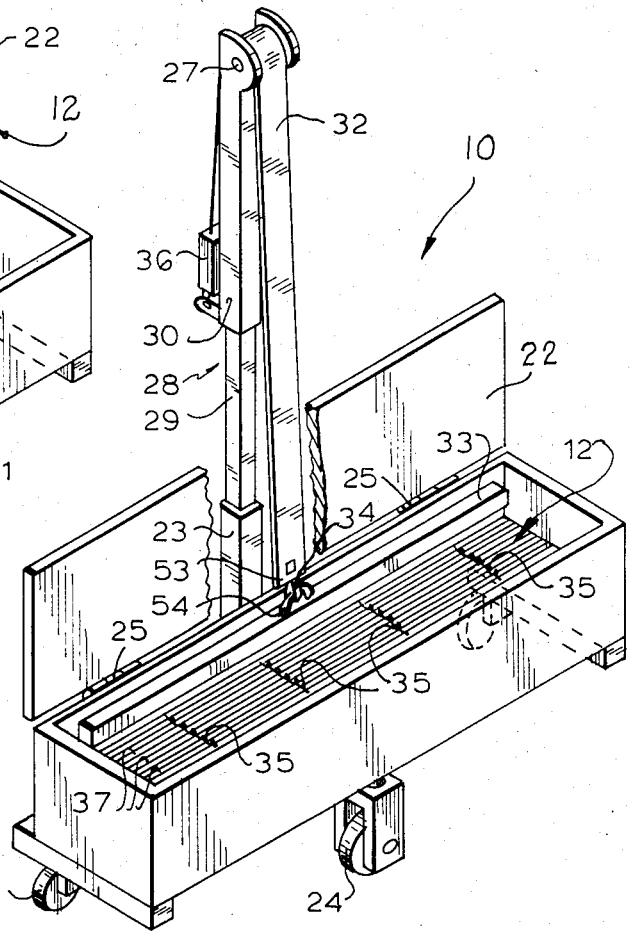
FIG. 2 is a perspective view of the device of FIG. 1, with the radiation shield in the collapsed position.
Figure 3:
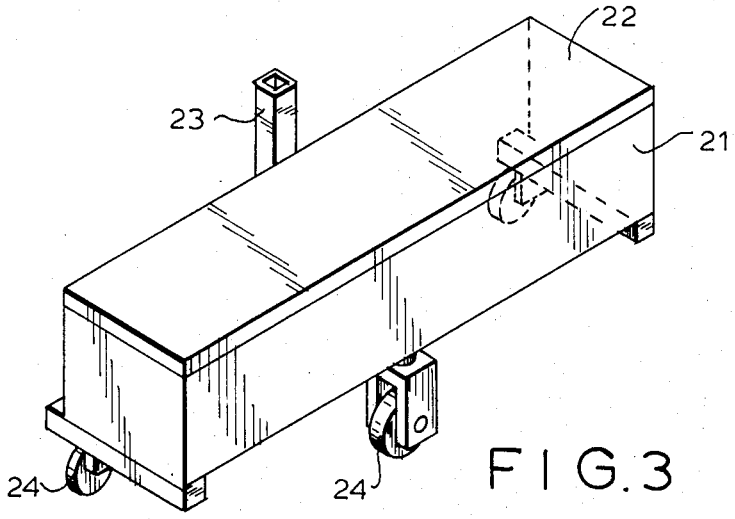
FIG. 3 is a perspective view of the radiation shielding system shown in FIGS. 1 and 2, with the upright support member disassembled and stored in the container and the container top closed.

Referring now to the drawings in detail, and initially to FIGS. 1 and 2, a radiation shielding system 10 constructed in accordance with one embodiment of the present invention is illustrated which includes a container or box 21 that is adapted to contain a collapsible radiation shield 12. The shield 12 is adapted to be extended or raised into its erect position (FIG. 1), with the aid of a mast 28, for providing radiation protection.

In this embodiment, the mast is mounted in a lower support bracket 23 consisting of a hollow rigid tube secured in any convenient manner to the container 21. The mast includes an upper section 30 which is telescopically engaged with a smaller cross-sectional lower section 29 that is removably inserted in mast support bracket 23. The two mast sections are removably connected in any convenient manner so they can be separated and stored on top of the shield 12 when the shield is collapsed into box 21.

Container 21, in this embodiment, is supported on a plurality of wheels 24 secured thereto in any convenient manner made to facilitate movement of the device from one location to another. The container 21 also includes a top 22 secured thereto by hinges 25.

Mast 28 and container 21 are fabricated of any suitable material having acceptable strength characteristics and are preferably formed of steel.

Radiation shield 12 is raised and lowered with respect to box 21 by means of a cable or strap 32 which is connected by any convenient means, here shown as a hook 34 at its free end 53 to a lifting bar 33 secured to shield 12. The opposite end of the strap 32 is secured to a power hoist 36 mounted on mast element 30. The hoist may be a hydraulic or electric winch or even a manual winch for winding and unwinding the strap or cable.

Figure 6:
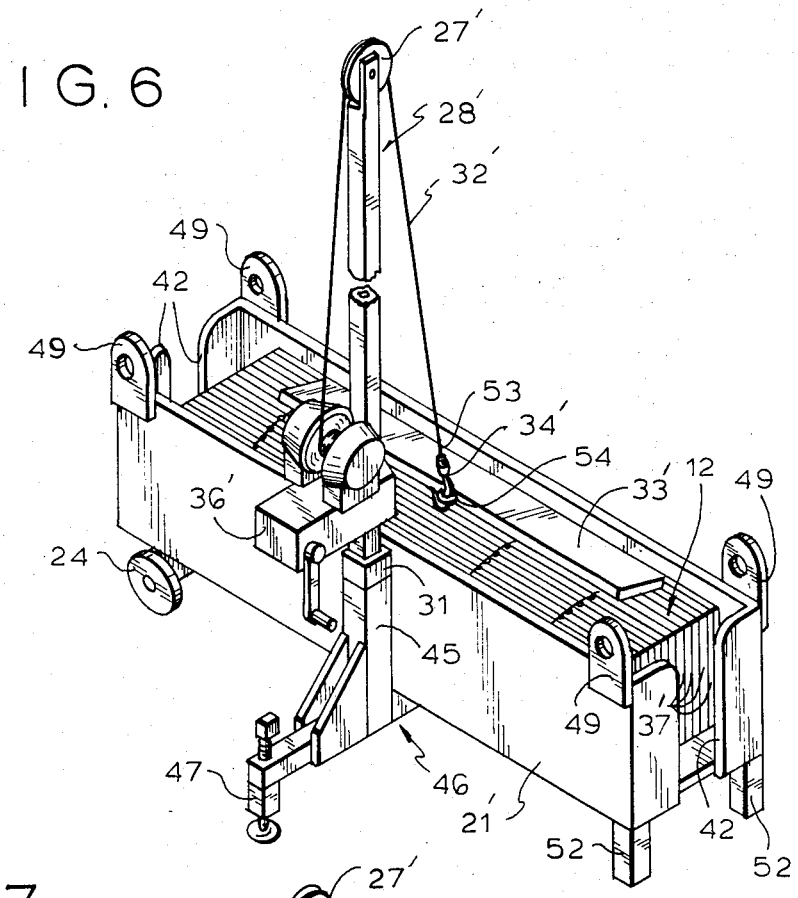
FIG. 6 is a perspective view of the radiation shielding system of another embodiment of the invention with the shield in its collapsed or lowered position and with the outrigger and mast attached.
Figure 7:
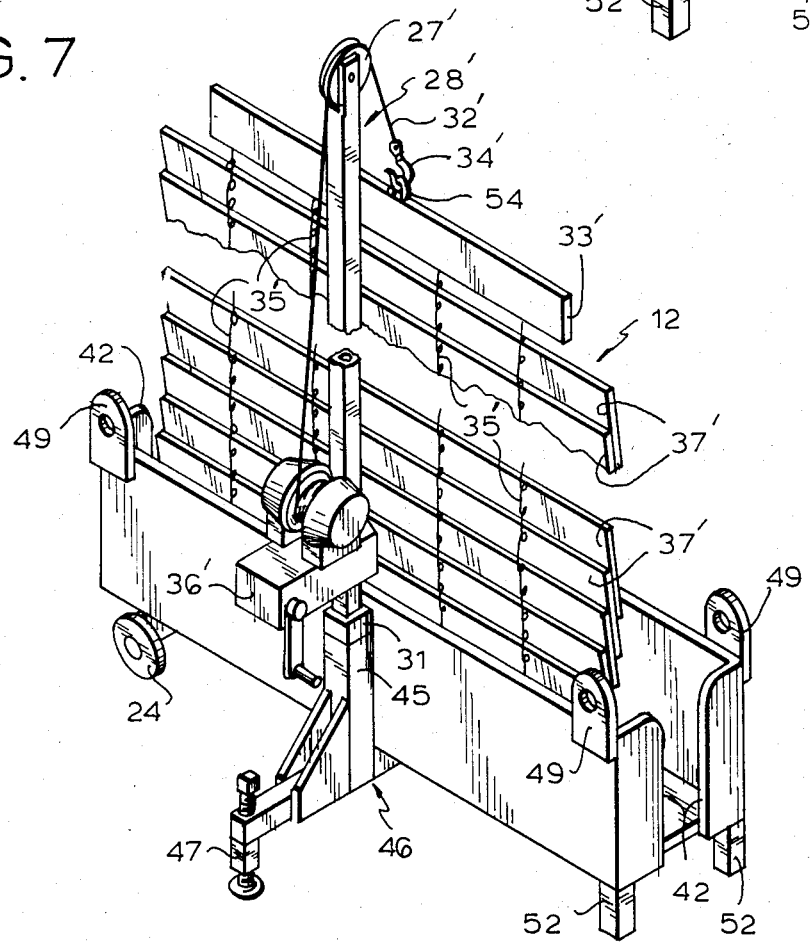
FIG. 7 is a perspective view of the radiation shielding system of FIG. 6 illustrating the shield in its raised position.
Figure 8:
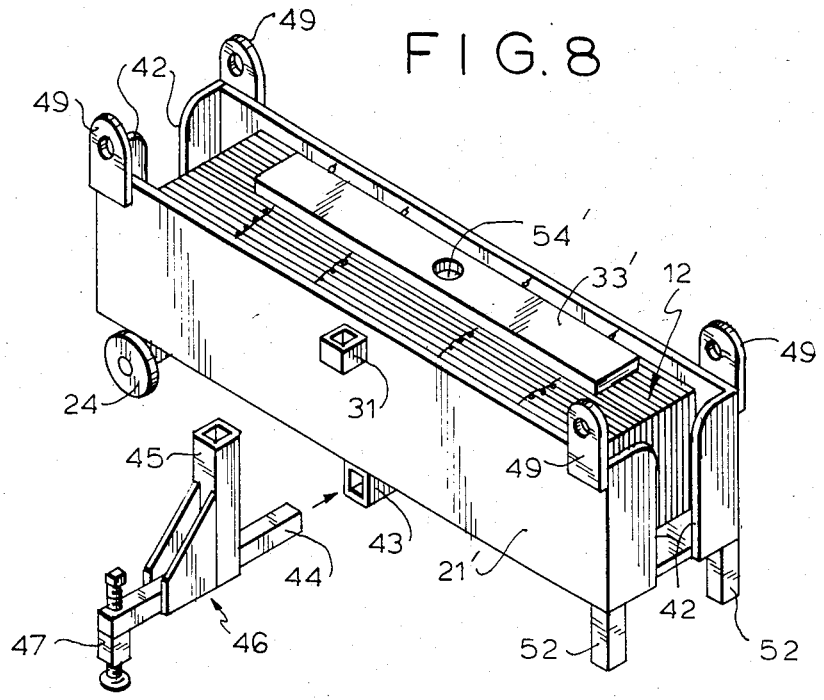
FIG. 8 is an exploded perspective view illustrating the method of connection and removal of the outrigger member for the device of FIG. 6.

Strap 32 is trained over pulley 27 rotatably mounted on the top of mast 28, and is formed of flexible steel or the like. Alternatively, a cable may be used in lieu of strap 32, as described hereinafter with respect to the embodiment of FIG. 6.

Radiation shield 12 is formed of a plurality of generally rectangular elongated lead wool blanket slats 37 which are flexibly connected to each other by suspension chains 35 which permit slats to move between their collapsed and raised positions shown in FIGS. 2 and 1 respectively, upon operation of hoist 36.

Lifting bar 33 is connected to the top edge of the upper most of slats 37 by any convenient suspension means, such as chain links 35. The connection between the lifting bar 33 and strap 32 at the connection point can be in the form of a hook 34 and eye 54, as shown, or in any other convenient manner forming a firm yet flexible connection therebetween.

Upon operation of hoist 36 to wind up strap 32 therein, the resulting upward movement of lifting bar 33 draws the upper most slat 37 from box 21, and continued upward movement causes each succeeding slat to be moved up and out of the box while drawing the next slat with it. In the fully erected and raised position, shown in FIG. 1, slats 37 are in an overlapping relationship and are oriented with their major dimension horizontal.

As mentioned, slats 37 are flexibly connected to each other by chains 35, although other suspension means, such as cables, may be used. A plurality of chain links 55 are attached to the top edge of each of the horizontal slats 37 in any convenient manner. As shown in FIG. 5, in one embodiment, additional links 38 are provided at spaced locations along the chains to form the required connections to the top edges of slats 37. Links 38 and 55 can be cold formed "S" hooks or screw pin shackles which are commonly used to link chains together or attach things to them. As seen in FIG. 4, the suspension chains 35, in the raised position of the shield, extend down from the lifting bar 33 to the top edge of the bottom most slat in the shield. The lifting bar may be omitted if the suspension chains are each separately hoisted, as could be the case when more than one mast is provided. Alternatively, the uppermost slat may act as both shielding slat and lifting bar.

The shield 12 is not connected to box 21 in any way. Thus, if desired, the shield can be raised to its erect position without the mast by an overhead crane or the like and moved to any desired position away from the box.

Referring again to FIG. 5, the front face 40 of each slat 37 is juxtaposed against the back face 41 of the slat which is above it in the raised position, with the upper slat overlapping the one immediately below it and covering the upper portion of its front face. Slats 37 should be of sufficient width (i.e. height in the vertical direction) so that when they are suspended, as shown in FIG. 5, the bottom edge 39 of each slat preferably extends down to a point near the top edge 51 of the slat which is immediately below the slat to which it is adjacent and which it is overlapping in a shingle-like fashion. With the slats arranged in this overlapping manner, the effective radiation shield thickness for the shield in the erected and raised condition is approximately double the thickness of each individual slat.

FIGS. 6–9 illustrate an alternative embodiment of the invention in which a container 21' is provided that has an opening 42 formed at each end to facilitate removal of the shield laterally from the enclosure, through the opening 42, when the shield is supported by a structure other than a mast. Container 21' also includes lifting lugs 49 secured to each of its corners to facilitate transportation of the radiation shielding system by means of an overhead crane or the like.

To permit the radiation shield of this embodiment to be manually moved about, the enclosure 21' has a pair of wheels 24 (only one of which is seen in the drawing) mounted thereon at one end with two support posts or legs 52 at the other end. The support posts prevent the container or enclosure 21' from moving when it has been moved into position for raising the shield. To move the enclosure, a separate lift jack handle (not shown) of conventional construction may be provided. Such lift jacks consist of elongated handles having a set of wheels on their ends and extended tongue or fingers which can be inserted below the enclosure between posts 52 to raise them off the floor. The container can then easily be moved on its wheels and that of the jack into and out of position.

In this embodiment, the radiation shielding system has an outrigger 46 mounted to the container for providing stability when the radiation shielding system is in a raised condition. The outrigger includes a connection member or bar 44 having a generally square cross section which is adapted to slide into and be received by a complementary bracket 43 mounted on the bottom or enclosure 21'. A conventional jackscrew 47 is mounted on the opposite or outward end of bar 47 and serves as a support foot which permits the outrigger to conform with grade level.

Figure 9:
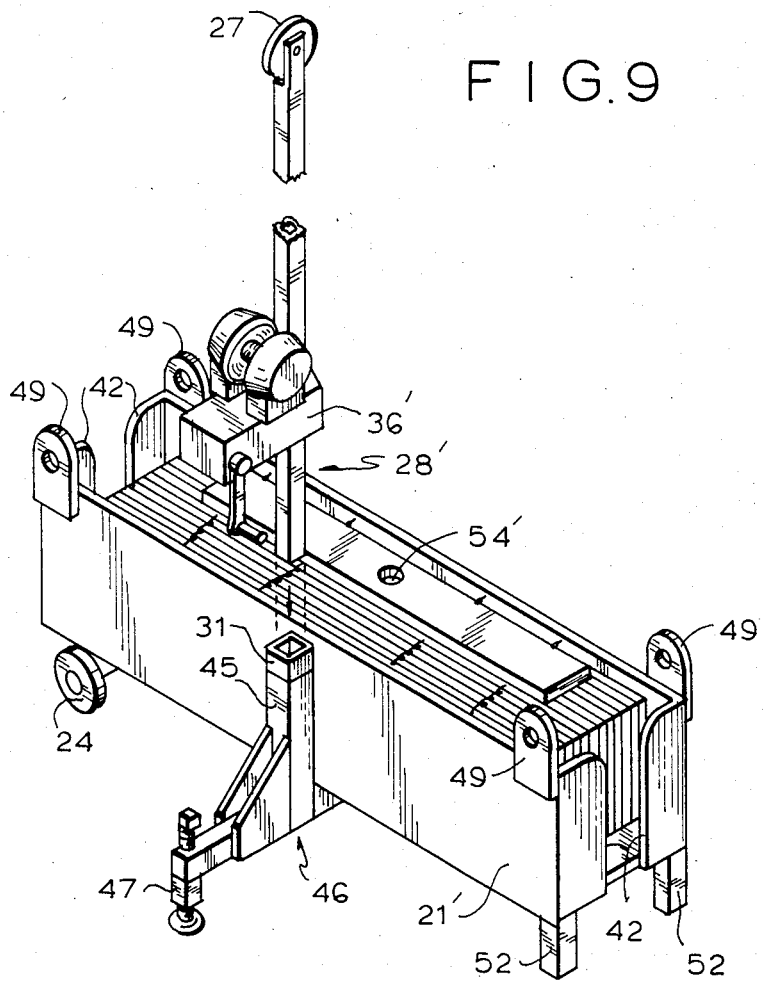
FIG. 9 is an exploded perspective view illustrating connection and removal of the mast with the guide bracket and outrigger for the device of FIGS. 6–8.

As shown in FIG. 9, a mast 28' is provided which is connected to the container frame and to the outrigger through a guide bracket 31 secured to the container. The mast 28' is generally square or polygonal and its lower end passes through bracket 31 and is removably received in the hollow upper end of the tubular support post 45 secured to the bar 44 of the outrigger.

As shown in FIG. 9, when outrigger 46 is properly connected with bar 44 in bracket 43, the mast support post 45 is disposed immediately below guide bracket 31. Then, when mast 28' is passed through guide bracket 31 into the mast support post 45, it is removably connected to the container and to the outrigger and prevents inadvertent removal of the outrigger from the container. Moreover, if the operator attempts to mount mast 28' to the container 21 by means of guide bracket 31 alone, the mast will be unstable. This instability will be immediately obvious to the operator, so that the operator will recognize that the outrigger member 46 must be properly mounted prior to mounting of mast 28'. In this way, it is insured that the outrigger member 46 will always be properly mounted to provide needed stability to the radiation shielding system prior to mounting of the mast. This outrigger system may also be used with the embodiment of FIG. 1 if desired.

A hoist 36', e.g. a conventional winch, is mounted on mast 28'. This winch may also be either a manual winch or it may be operated by any conventional motive means, such as an electric motor, a pneumatically powered motor, or a hydraulic jack. The winch winds and unwinds a cable 32' which is suspended over pulley 27' and connected by a hook 34' at its free end to a lifting bar 33' through eye 54 (or 54', as in FIGS. 8 and 9). The lifting bar 33' is connected by chain 35' to the lead wool blankets or slats 37' of the radiation shield in the same manner as described above with respect to the embodiment of FIG. 1. Thus operation of winch or hoist 36' will cause the shield to be raised and lowered in the same manner.

In both embodiments, when the shield is lowered into the container, the bottom 39 of the lowermost slat 37 (or 37') contacts the top surface of the bottom of the container. Due to the slight backward angle at which the slat is hanging, as it rests on the bottom of the container it will tip towards the back side of the container and rest against it. The slat immediately above it then slides down with its backface on the frontface of the lowermost slat behind it until that slat similarly rests on the bottom of the enclosure. As each slat is lowered in turn, the section of the suspension chain supporting it becomes loose and collapses along the top edge of the slats as they rest on the bottom of the enclosure. As lowering continues, each slat slides down along the adjacent slat behind it until each slat is resting in a substantially upright position on the bottom of the container, with the suspension chains collapsed near the top edge 51 of the slats as they form a horizontal stack, one in front of the other, in the container.

Alternatively, if the container is sufficiently wide, and the shield is lowered in such a way that the lowermost slat contacts the bottom of the container near its front end so that the slat is free to fall back into a horizontally flat position, the remaining slats will similarly follow, laying flat and forming a vertical stack with the suspension chains 35 (or 35') collapsed along the side of the stack.

Accordingly, it is seen that a relatively simple radiation shielding system is provided by this invention which permits rapid and effective deployment of a radiation shield for use in emergency situations or the like.

The terms and expressions which have been employed herein are used as terms of description and not of limitation, and there is no intention in the use of such terms and expressions of excluding any equivalents of the features shown and described or portions thereof. Although illustrative embodiments of the invention have been described herein with reference to the accompanying drawings, it is to be understood that various changes and modifications can be effected therein without departing from the scope or spirit of the invention.

What is claimed is:

1. A vertically collapsible radiation shield device including a shield adapted to be moved between a first raised condition and a second collapsed condition, flexible suspension means for raising and lowering said shield; said shield including a plurality of overlapping horizontally elongated slats of radiation shielding material, each of which is individually attached near its top edge to said suspension means so that said slats are individually suspended at spaced intervals along the suspension means.

2. The collapsible radiation shield device as defined in claim 1, wherein said slats are attached to said suspension means from horizontally spaced apart positions on each of said slats.

3. The collapsible radiation shield device as defined in claim 2, wherein said suspension means includes flexible support members secured at spaced intervals along their lengths to points near the top edges of said slats so that when said shield is in the raised condition the slats are suspended from said support members and arranged horizontally in an overlapping manner, and so that when said shield is in the collapsed and lowered condition, said slats are arranged in a horizontal stack with the front of each said slats juxtaposed against the back of the slat which is adjacent thereto.

4. The collapsible radiation shield device as defined in claim 3, wherein said flexible support members comprise horizontally spaced apart chains.

5. The collapsible radiation shield device as defined in claim 4, wherein said slats are dimensioned to overlap their adjacent slats so that the mean effective thickness of the shield is approximately double the thickness of each individual slat.

6. The collapsible radiation shield device as defined in claim 5, wherein said suspension means includes a lifting bar from which said suspension means are hung positioned near the topmost slat of said radiation shield when said shield is in the erected and raised condition.

7. The collapsible radiation shield device as defined in claim 2, wherein said flexible support members comprise horizontally spaced apart chains.

8. A collapsible radiation shielding system comprising:

(a) a portable support structure;

(b) flexible suspension means;

(c) a vertically collapsible radiation shield comprising a plurality of overlapping horizontally elongated slats of radiation shielding material, each of which are individually suspended from said suspension means by attachment means near the top edges of said slats;

(d) an upright support member attached to said support structure;

(e) means for hanging said radiation shield from said upright support member; and (f) means for lifting said radiation shield from a lowered and collapsed condition to a raised condition.

9. The radiation shielding system as defined in claim 7 wherein said support structure includes a container for receiving said radiation shield when it is in said collapsed and lowered condition.

10. The radiation shielding system as defined in claim 8, wherein said container has an opening at at least one end through which said shield may pass when in its raised position.

11. The radiation shielding system as defined in any one of claims 7, 8, or 9, including an outrigger member extending from said support structure in a direction generally normal to the plane of said radiation shield when said shield is in its raised condition and having an outward end at grade level for supporting and stabilizing said support structure.

12. A collapsible radiation shielding system comprising:

(a) suspension means;

(b) a vertically collapsible radiation shield;

(c) a portable support structure including a container for receiving said radiation shield when it is in a collapsed and lowered condition, said container having an opening at least one end through which said shield may pass when in its raised position and further including an outrigger member extending from said support structure in a direction generally normal to the plane of said radiation shield when said shield is in its raised condition and having an outward end at grade level for supporting and stabilizing said support structure, said outrigger member being demountable from said support structure, said outrigger member further comprising a connection member and a mast support post adapted to receive said mast, and wherein said support structure further includes a connection member receiving bracket adapted to receive said outrigger connection member, said connection member receiving bracket being aligned with a mast guide bracket so that when said outrigger member is mounted to said support structure, said mast is fixed in place by both said mast guide bracket and said mast support post and so that when said outrigger member is not mounted or improperly mounted to said support structure, said mast cannot be supported from said mast guide bracket without instability obvious to the operator;

(d) an upright support member attached to said support structure;

(e) means for hanging said radiation shield from said upright support member; and (f) means for lifting said radiation shield from a lowered and collapsed condition to a raised condition.

13. The radiation shielding system as defined in claim 11, wherein said mast is demountable from said support structure.

14. The radiation shielding system as defined in claim 12, wherein said mast is disassemblable to a size such that it will fit within the enclosure.

15. The radiation shielding system as defined in claim 12, wherein said support structure has means for receiving said mast for stowage when said upright support member is demounted from said support structure.

16. A collapsible radiation shielding system comprising:

(a) a portable support structure;

(b) a vertically collapsible radiation shield, said shield having a first raised condition and a second collapsed condition, said shield including flexible suspension means, a plurality of horizontally elongated slats of radiation shielding material, each of said slats being individually suspended from said flexible suspension means, said slats being suspended at spaced intervals along said suspension means with the major dimension of said slats in a generally horizonal orientation so that when said shield is in said raised condition the slats are individually suspended from said flexible suspension means and arranged horizontally in an overlapping manner, and so that when said shield is in said collapsed condition the backs of said slats are juxtaposed against the fronts of the slats which are adjacent thereto;

(c) a mast mounted to said support structure;

(d) means for hanging said radiation shield from said mast; and (e) means for lifting said radiation shield from said collapsed condition to said raised condition.

17. The radiation shielding system as defined in claim 16, wherein said support structure includes a container for receiving said radiation shield when it is in said collapsed condition.

18. The radiation shielding system as defined in claim 17, wherein said enclosure has an opening at at least one end to permit said shield to pass therethrough when in the raised condition.

19. The radiation shielding system as defined in any one of claims 16, 17, or 18, wherein said support structure includes an outrigger member extending in a direction generally normal to the plane of said radiation shield when said shield is in the raised condition, said outrigger having an outward end at grade level for supporting and stabilizing said radiation shielding system.

20. A collapsible radiation shielding system comprising:

(a) a vertically collapsible radiation shield having a first raised condition and a second collapsed condition, said shield including suspension means, a plurality of horizontally elongated slats of radiation shielding material, said slats being suspended at spaced intervals along said suspension means with the major dimension of said slats in a generally horizontal orientation so that when said shield is in said raised condition the slats are suspended from said suspension means and arranged horizontally in an overlapping manner, and so that when said shield is in said collapsed condition the backs of said slats are juxtaposed against the fronts of the slats which are adjacent thereto;

(b) a portable support structure, said support structure having a container for receiving said radiation shield when it is in said collapsed condition, said container having an opening at at least one end to permit said shield to pass therethrough when in the raised condition and an outrigger member extending in a direction generally normal to the plane of said radiation shield when said shield is in the raised condition, said outrigger having an outward end at grade level for supporting and stabilizing said radiation shielding system, said outrigger member being demountable from said support structure and including a connection member and a mast support post adapted to receive said mast, a connection member receiving bracket on said support structure for receiving said connection member, a mast guide bracket on said support structure in position to be aligned with said mast receiving bracket when said outrigger member is mounted to said support structure, said mast being fixed in place by both said mast guide bracket and said mast support post and so that when said outrigger member is not mounted for improperly mounted to said support structure, said mast cannot be supported from said mast guide bracket without instability obvious to the operator;

(c) a mast mounted to said support structure;

(d) means for hanging said radiation shield from said mast; and (e) means for lifting said radiation shield from said collapsed condition to said raised condition.

21. The radiation shielding system as defined in claim 20, wherein said mast is demountable from said support structure.

22. The radiation shielding system as defined in claim 21, wherein said mast is disassembled to a size such that it will fit within the enclosure.

23. The radiation shielding system as defined in claim 22, wherein said support structure includes means for receiving said mast for stowage when said upright support member is demounted from said support structure.

* * * * *